US006533518B1

(12) United States Patent
Turner et al.

(10) Patent No.: US 6,533,518 B1
(45) Date of Patent: Mar. 18, 2003

(54) CAN END MANUFACTURING SYSTEM AND PRESS THEREFOR

(75) Inventors: Timothy L. Turner, Pecatonica, IL (US); Randall G. Forrest, Park Ridge, IL (US); Carlton Young, Westchester, IL (US)

(73) Assignee: Rexam Beverage Can Company, Chicago, IL (US)

( * ) Notice: Subject to any disclaimer, the term of this patent is extended or adjusted under 35 U.S.C. 154(b) by 0 days.

(21) Appl. No.: 09/387,025

(22) Filed: Aug. 31, 1999

(51) Int. Cl.[7] ..... B21D 51/44

(52) U.S. Cl. ..... 413/12; 413/14; 413/16; 413/19

(58) Field of Search ..... 413/8, 12, 14, 413/15, 16, 17, 18, 19, 56, 66, 67, 68; 72/404, 405.06

(56) References Cited

U.S. PATENT DOCUMENTS

| | | | | |
|---|---|---|---|---|
| 2,601,625 A | | 6/1952 | Peterson, Jr. et al. | |
| 3,292,412 A | * | 12/1966 | Costabile | 72/404 |
| 3,338,084 A | * | 8/1967 | Stegman, Sr. | 72/404 |
| 3,366,086 A | | 1/1968 | Fraze | |
| 3,886,881 A | | 6/1975 | Pearce et al. | |
| 3,888,199 A | | 6/1975 | Herrmann | |
| 3,981,652 A | * | 9/1976 | Lovell et al. | 413/18 |

(List continued on next page.)

FOREIGN PATENT DOCUMENTS

| | | | |
|---|---|---|---|
| GB | 1525957 | 9/1978 | B21D/51/38 |
| GB | 2028179 | 3/1980 | B21D/51/44 |

OTHER PUBLICATIONS

PCT International Search Report for PCT Application of American National Can Co., PCT/US00/20088, dated Nov. 22, 2000.

Formatec Tooling Systems Inc., Shell Forming document, (date unknown, circa 1990).

Stolle Machinery, Stolle Conversation System 8 Manual, pp. 1–1 to 1–24 (1996).

Prior Art System described at pp. 4–6, shown in Fig. 1 of present application.

*Primary Examiner*—John Sipos
*Assistant Examiner*—Louis Huynh
(74) *Attorney, Agent, or Firm*—McDonnell Boehnen Hulbert & Berghoff

(57) ABSTRACT

Ends for cans are made in a single press, eliminating the need for separate shell and conversion presses, balancers, track work, and other equipment, as compared to existing can end manufacturing systems, while reducing floor space and capital investment requirements for installation of a new can end line. A sheet of end material or stock is introduced into the press and fed to a series of work stations. The sheet is maintained in a substantially continuous and void free state as the work stations perform forming operations on the sheet of material to form one or more ends therein. After the forming operation is complete, the end is ejected from the press. The maintenance of the sheet of material in a substantially continuous and void free state permits precise movement of the sheet through the press, and registration of the sheet relative to the tooling in the press. This precise movement and maintenance of registration results in a single press capable of operation at high speeds to produce large volumes of ends, while doing so in a reliable and cost-effective manner. In a preferred embodiment, the typical shell conversion operations are performed first on the sheet of end material, while maintaining the sheet in a substantially planar and void free state, followed by a shell forming operation in which the panel and countersink features are formed and the completed end blanked in a single stroke at the very end of the forming operations.

14 Claims, 7 Drawing Sheets

U.S. PATENT DOCUMENTS 4,026,226 A 5/1977 Hahn et al.
4,106,422 A 8/1978 Buhrke
4,136,629 A * 1/1979 Luthi ..... 413/14
4,244,315 A * 1/1981 Klein ..... 413/17
4,266,310 A * 5/1981 Perrault et al. ..... 72/404
4,424,698 A * 1/1984 Langseder ..... 413/14
4,543,811 A * 10/1985 Aoyama ..... 72/404
4,568,230 A 2/1986 Brown
4,640,116 A 2/1987 Brown
4,681,001 A * 7/1987 Uehlinger et al. ..... 83/37
4,723,882 A 2/1988 Wissman et al.
4,854,799 A * 8/1989 Herdzina et al. ..... 413/12
4,936,729 A 6/1990 Herdzina, Jr.
5,142,769 A * 9/1992 Gold et al. ..... 413/56
5,158,410 A * 10/1992 Hunt ..... 413/56
5,209,098 A * 5/1993 Cudzik ..... 413/56
5,473,926 A * 12/1995 Futamura et al. ..... 72/404
5,511,920 A 4/1996 Atrip ..... 413/25
5,741,105 A * 4/1998 Schubert et al. ..... 413/14
5,876,171 A 3/1999 Martin et al.
6,022,179 A * 2/2000 Artrip ..... 413/14
6,027,436 A * 2/2000 Sakaguchi et al. ..... 413/8

* cited by examiner

FIG. 1A
PRIOR ART
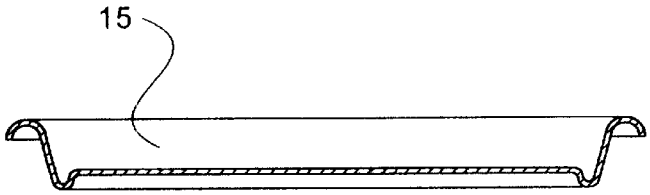
FIG. 1B
PRIOR ART
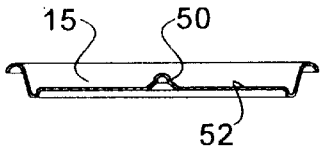
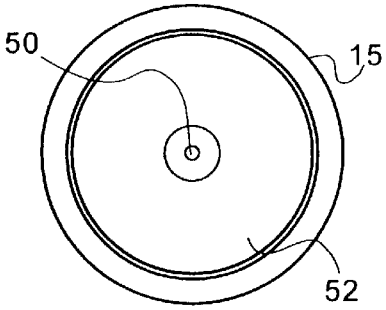
FIG. 1C
PRIOR ART
FIG. 1D
PRIOR ART
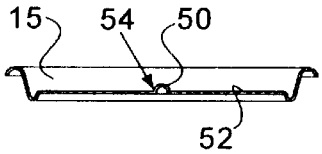
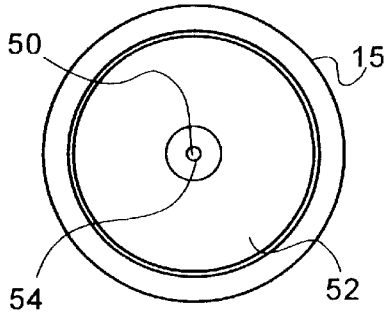
FIG. 1E
PRIOR ART FIG. 1F
PRIOR ART
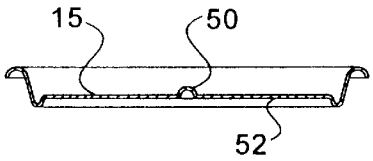
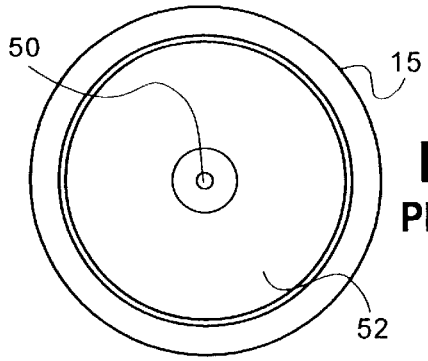
FIG. 1G
PRIOR ART
FIG. 1H
PRIOR ART
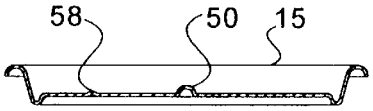
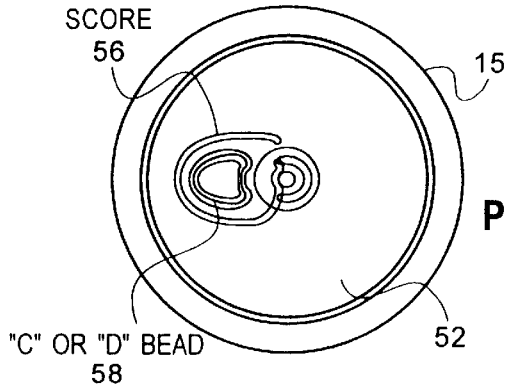
FIG. 1I
PRIOR ART
FIG. 1J
PRIOR ART
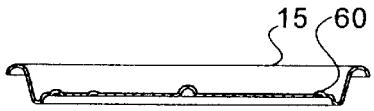
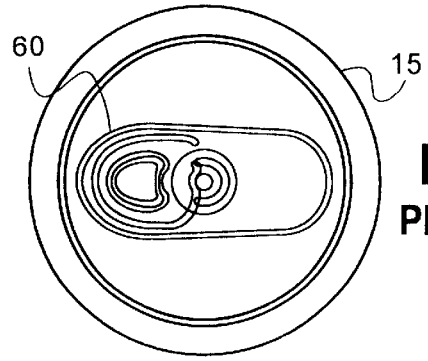
FIG. 1K
PRIOR ART
FIG. 1L
PRIOR ART
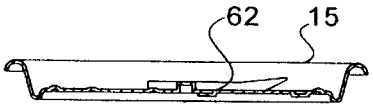
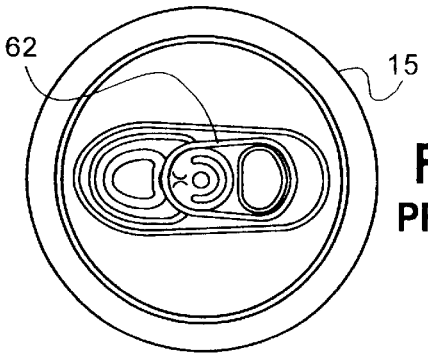
FIG. 1M
PRIOR ART

CAN END MANUFACTURING SYSTEM AND PRESS THEREFOR

BACKGROUND OF THE INVENTION

A. Field of the Invention

This invention relates to the art of manufacturing ends for cans, such as, for example, ends that close off aluminum beverage cans, ends for cans containing human or animal foods, and ends for containers for consumer products such as tennis balls. The invention also relates to a press that is used to make can ends and the methods by which such a press operates to form an end out of a sheet or coil of stock material.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using conventional cup forming punch and die equipment. The cup is then transferred to a body maker or can forming station. The body maker draws and irons the side walls of the cup to approximately the desired height and forms dome or other features on the bottom of the can. After formation of the can by the body maker, the top edge of the can is trimmed. The can is transferred to a necking station, where neck arid flange features are formed on the upper region of the can. The flange is used as an attachment feature for permitting the lid for the can, known as an "end" in the art, to be secured to the can.

The end is the subject of a different manufacturing process and involves specially developed machines and systems to manufacture such ends in mass quantities. Representative patents describing end manufacturing methods and presses used to make such ends include Buhrke, U.S. Pat. No. 4,106,422, and Herrmann, U.S. Pat. No. 3,888,199. After the ends are manufactured they are bagged in large stacks (known in the art as "sticks" or "in stick form") and sent to a site where the cans are filled with a food,.beverage, or other product.

In the Buhrke '442 patent, a sheet or web of end material is fed into a press. The sheet is pierced, notched, and lanced according to a predetermined pattern at longitudinally spaced intervals to define a series of identical individual can top blanks. The blanks are separated in the web from each other by substantial openings void regions, but linked together by flexible "links", that is, portions of the web material that connect the blanks together. See, e.g., FIGS. 1, 2 and 3 of the Buhrke '422 patent. After the sheet has been so formed, the sheet is sent to a series of stations of a single progressive die that complete for formation of the end in the web or sheet of material. The web material and links act as a carrier of the blanks until the ends are cut out of the web, whereupon the ends are sent to edge curling and finishing stations within the press.

While the Buhrke system was put into practice and used for a period of years during the early 1980's, it was prone to problems and ultimately unsuccessful. In particular, the void features formed in the sheet of material in the beginning of the operations in the press created an elastic condition when the sheet was indexed through the press, leading to registration problems between the sheet of material and downstream work stations that formed the closure and other features in the end. More specifically, the void features led to relative movement between various portions of the sheet when the indexing mechanism moved the sheet through the press, resulting in a mis-alignment between the tools of the work stations and the portion of the sheet containing an end in various states of completion. Furthermore, the machine had a relatively low metal realization since the design requires material to carry the ends through the press. The resulting down-time to change the position of the dies, slow speed of operation, poor quality of ends due to the misalignment, and overall maintenance and metal utilization problems experienced by machines made in accordance with the '422 Buhrke patent eventually resulted in the abandonment and eventual replacement of such machines. The company is no longer in the business of making shell forming presses.

The Herrmann '199 patent also describes an end manufacturing process performed on a sheet of end material. In particular, a sheet of material is fed into the press, and initial forming operations and lancing of a press tab opening feature are performed. Then, the end is blanked. The blanked ends are then fed to downstream work stations, where various additional forming operations are performed on the ends. The Herrmann '199 patent was commercialized for a short time, but such machines were.soon abandoned and replaced.

During the mid-to-late 1980s, the art moved away from systems that attempted to form a complete end in a single machine, as typified by the Herrmann and Buhrke patents. The art adopted a two-stage type of system using a shell press that formed shells from a coil of stock material, and one or more end conversion presses that converted the shell into a finished end. A representative prior art shell press and end conversion system is illustrated schematically in FIG. 1. The system of FIG. 1, described below, was a much more complex and capital-intensive system than those systems used previously. However, the increased capital investment required to build an end making line such as shown in FIG. 1 was believed justified since the system proved to be more reliable, required less maintenance and down time, and was capable of operating at higher speeds to produce more can ends per minute than prior systems.

The end manufacturing system 10 of FIG. 1 operates as follows. A coil stock feed mechanism 12 supplies a continuous sheet of end material (e.g., aluminum or steel), to a shell press 14. The shell press has a set of tools that form a shell in the sheet of end material and blank the shell from the sheet. Shell presses such as shown in FIG. 1 are made by companies such as Formatec Tooling Systems, Inc. and Redicon Corp. and are well known in the art. The shell press 14 in the instant example is a twenty four-out press (i.e., it forms twenty four shells in the sheet of material a direction transverse or oblique to the direction of movement of the sheet in the press). Shells are ejected out both sides of the press 14 and sent to curlers 16, where an edge curl is formed in the periphery of the shell, resulting in the shell 15 shown in FIG. 1A.

After curling, the shells are placed in stick form and moved along track work indicated at 20 to a balancer 22. The balancer 22 is a robotic distribution machine. It is needed because the curlers 16 are supplying shells along six sets of track work 20, whereas in the downstream direction there are only four sets of track work leading to four liner machines 24. The balancer 22 is used to collect the ends and appropriately distribute them to track work leading to the lining machines 24. The lining machines 24 add a compound liner to the shells. The lining machines supply the shells to a drying machine 26 (if a water-based compound is used), which dries the compound liner with forced air. The drying machine 26 is not needed if a solvent-based compound is used.

The drying machines 26 supply the shells along another set of track work 30 to a second balancer 32. The balancer 32 supplies shells in stick form to three sets of track work, 34, 36 and 38 leading to three separate shell conversion presses 40. The conversion presses 40 take the shells of FIG. 1A and complete the formation of the end features in the shell. The conversion presses 40 also have a set of tools that receive a continuous sheet of tab stock from a source 42 and form tabs in the tab stock. The conversion presses 40 attach the tab to the shell, complete the formation of the ends, and supply the finished ends to three sets of track work 43 leading to three bagging stations 44. The converted ends are bagged in stick form and loaded on pallets for distribution to the site where the cans are filled with product.

The conversion presses 40 of FIG. 1 are also known in the art and commercially available from Stolle Machinery Inc., Dayton Reliable Tool & Mfg. Co., and Service Tool Company, among others. They are also described in the patent literature. See U.S. Pat. No. 3,886,881, U.S. Pat. No. 4,732,882; U.S. Pat. No. 4,568,230, and U.S. Pat. No. 4,640,116, the contents of each of which is incorporated by reference herein. The tab presses for forming tabs in the sheet of tab stock are also known and commercially available. See, e.g., the Stolle Conversion System 8 shell conversion press available from Stolle Machinery Inc., and the above referenced '230 patent.

The conversion presses 40 of FIG. 1 all work in the same fashion. They incorporate a series of work stations having tools that complete the formation of an end from a shell 15 supplied from the balancer 32. The details of the work stations and forming operations performed on the shell will depend on the type of end and the requirements of the customer.

A representative embodiment for producing an end for a beverage can in the conversion press will be described for purposes of example. The operation of the first station in the shell conversion press 40 of FIG. 1 is shown in FIGS. 1B and 1C. A bubble 50 is formed in the center of the panel 52 of the shell 15. The bubble is the first step in the formation of a rivet that is used for attaching a tab to the end. At the second station, the bubble 50 is reformed to reduce the radius at 54 as shown in FIGS. 1D and 1E. At the third work station, the bubble is reformed a second time with a smaller radius at its base to allow the tab to be seated closer to the panel 52, as shown in FIGS. 1F and 1G.

At the fourth station, indicated in FIGS. 1H and 1I, the shell 15 is scored 56 to define an opening in the shell and a C-bead or a D-bead 58 is formed in the center of the panel 52 to remove excess metal put into the area by the scoring process. At the fifth station, indicated in FIGS. 1J and 1K, the panel 52 is formed in the region 60, giving the end strength. Excess metal accumulated during previous forming operations is pulled out. At the sixth station, indicated in FIGS. 1L and 1M, a tab 62 is cut off from its web, superimposed on the bubble/rivet 50, and riveted to the end. At a seventh-station, indicated in FIG. 1N, the edges of the tab 62 are wiped down in regions 64 to remove sharp edges from the tab. Finally, in the eighth station of FIG. 1O, the end is either embossed or incised with lettering indicated at 66 depending on the customer requirements. This completes the formation of an end 70. The end 70 is then ejected from the press, placed in a stick of ends, and sent to a bagging station for bagging and loading on a pallet, as shown in FIG. 1.

The system of FIG. 1, while certainly capable of producing ends at high speed and in a reliable fashion, has several drawbacks. First, an enormous capital investment is required to install a system such as shown in FIG. 1. In particular, a large amount of expensive track work is required. The system requires two balancers and a total of four presses, all of which are very costly machines. Further, the layout of the equipment requires a large amount of space and therefore a large building site, which increases the cost. Construction of such a building and providing heating and cooling also increases costs. Furthermore, the sheer number of presses and the balancers results in a system that consumes a lot of electrical power during operation, and a large number or operators and mechanics, increasing the costs further. While the system of FIG. 1 could be modified somewhat by reducing the number of conversion presses or eliminating the dryers, the basic architecture of the prior art system based on shell presses, conversion presses, balancers and extensive track-work is a very capital, space, energy and labor intensive system.

The present invention provides a substantial improvement over the end manufacturing system of the general type shown in FIG. 1. It also presents solves problems inherent in the Buhrke and Herrmann systems. As described below, the present invention provides for the formation of an end from a sheet of end material in a single press, thereby completely eliminating much of the track work, balancers, extra-presses, and space and capital requirements of the system of FIG. 1. Furthermore, there is no need for any balancers in the present system since there is only one press and the ends are fed directly from the curlers to the liners and to the bagging station. The cost savings to install a new end manufacturing system of the present invention, as compared to a new end making system in accordance with the prior art approach of FIG. 1, with the same capacity, is in the order of many millions of dollars. Further, the end making system of the present invention is particularly suitable to smaller scale implementations, but can be modularized to increase capacity without requiring substantial increases in floor space or capital

SUMMARY OF THE INVENTION

In one aspect of the invention, an end manufacturing system is provided. The system includes a source of a sheet of end material, such as aluminum or steel in coil form. The sheet of end material is supplied to a press. The press has a series of work stations that perform forming operations on the sheet of end material so as to form a complete end in the sheet material. The curling of the end can be either performed in the press or, more preferrably, in a curler machine after the end is ejected from the press. As the sheet of end material is fed through the press, the work stations work on the sheet to form the end, and, at the same time, maintain the sheet of end material in a substantially continuous and void-free state. The feature of maintaining the sheet in a substantially continuous and void free state allows the sheet to be advanced through the press in a precise and controlled manner. This results in maintenance of proper alignment of the sheet with respect to the tools as the end is formed by the work stations. Accordingly, the press can be operated at high speeds and in a reliable fashion. Also, this feature avoids the registration, elasticity and misalignment problems found with the prior art system, such as the Buhrke press, that attempted to make a complete end from a web or sheet in a single press. The press includes a station that blanks the ends from the sheet when the formation of the ends is complete. The ends are then ejected from the press.

In a preferred embodiment, the work stations are organized such that the operations traditionally performed in a conversion press are performed first, and with the shell forming operation performed in the very last step. This is essentially the reverse of the previous technique of forming the shell first and then converting the shell into an end by adding all the end features, such as, rivet, tab, pour panel, embossing, etc. By performing the operations on the sheet in the order provided by this invention, the sheet of end material is more readily indexed through the press in a controlled and reliable manner at high speed.

In an embodiment in which the curling is not performed in the press, the ends are fed to a curler station for curling the ends. The ends are then fed to a compound station applying a compound sealant to the ends. The ends are then fed to an inspection station and then to a bagging station for packaging the ends and loading on a pallet or other suitable structure.

In another aspect of the invention, a method of manufacturing can ends is provided that comprises the steps of introducing a sheet of end material into a press, and feeding the sheet of end material to a series of work stations in the press. The sheet of end material is worked in the series of work stations in a sequence of operations so as to complete the formation of an end in the sheet of end material. In contrast to the prior art approach described in the Buhrke and Herrmann patents, during the working of the end material the sheet of end material is maintained in a substantially continuous and void-free state. This permits the sheet feed mechanism to provide precise movement of the sheet relative to the work stations, and maintain registry of the sheet relative to the work stations as the sheet is fed through press. The method continues with the step of blanking the end from the sheet after the formation of the end has been completed. The ends are then ejected from the press.

The series of work stations in the press preferably include at least one station for forming a rivet in the sheet, a station for scoring the sheet so as to form an opening feature in the sheet, and a station for attaching a tab to the rivet. The stations may be arranged in said press such that the sheet of end material is fed through said stations in that order, fed to said blanking station, and then ejected from the press. The press can be a one-out press, that is, form only one end in a transverse orientation or at an oblique angle with respect to the direction of travel of the sheet. Alternatively, the press can be set up as a multiple-out press, such as a four-out press in the preferred embodiment.

The system of the above type can be readily implemented without the need for any balancers. The amount of expensive track work required is dramatically reduced. The separate shell press is eliminated. Since only one press is used per line, it results in a more compact arrangement. While a line with one press such as described herein may produce a smaller number of ends than a system say of FIG. 1, it could be implemented with a much reduced capital expenditure and investment. The system is a much more compact in terms of footprint, and can be installed in a smaller plant. All of these factors add up to a dramatic cost saving for installation of a new end manufacturing line.

As a result of the reduction in equipment needed to produce the ends, the maintenance and tooling costs are reduced. The equipment is easier to work on and simpler by design. It is even possible to modify an existing conversion press to that of the press of the present system by changing the tooling and the feed mechanism, without having to design an entirely new press from scratch. The energy costs are less since there is less equipment running.

Several other advantages are obtained by the system of the present invention. The system is easier to work on than existing shell and conversion systems, and it is easier to change the end diameter. The system is particularly suitable for niche markets and special end requirements.

Further, because there are no balancers, and no elaborate shell or end track work and distribution schemes such as shown in FIG. 1, there is complete traceability in the system. If a particular problem is found with an end at an inspection station at the end of the line, the problem can be traced to the particular tool or even portion of a tool in the press.

Furthermore, since the press is not working on individual ends, as is the case with a conversion press, but rather on a sheet of stock material, the press can operate on a shorter stroke. This, in turn, allows the press to run at faster speeds and produce more ends per minute than a system of similar space and capital requirements. Also, random orientation of the tooling relative to the grain in the end material, found in the prior art conversion presses, can be controlled since the ends are formed while maintained in a sheet of material (and not on individual shells), and the orientation of the grain relative to the press can be controlled by how the sheet is fed into the press. The grain of the sheet can be compensated for in a reliable and repeatable fashion by slight modification to the tooling. This, in turn, lowers the standard deviation of push, pop and buckle phenomenon in the ends and results in higher quality ends.

These and many other features and advantages of the invention will be more apparent from the following description of a presently preferred embodiment.

BRIEF DESCRIPTION OF THE DRAWINGS

A presently preferred embodiment of the invention is described below in conjunction with the drawings, in which like reference numerals refer to like elements in the various views, and in which:

FIG. 1A is a sectional view of a shell for an end produced by the shell press in the system of FIG. 1;

FIGS. 1B and 1C show a first operation performed on the shell of FIG. 1A in the conversion press of FIG. 1;

FIGS. 1D and 1E show a second operation performed on the shell of FIG. 1A in the conversion press of FIG. 1;

FIGS. 1F and 1G show a third operation performed on the shell of FIG. 1A in the conversion press of FIG. 1;

FIGS. 1H and 1I show a fourth operation performed on the shell of FIG. 1A in the conversion press of FIG. 1;

FIGS. 1J and 1K show a fifth operation performed on the shell of FIG. 1A in the conversion press of FIG. 1;

FIGS. 1L and 1M show a sixth operation performed on the shell of FIG. 1A in the conversion press of FIG. 1;.

DETAILED DESCRIPTION OF THE PREFERRED EMBODIMENTS OF THE INVENTION

Figure 2:
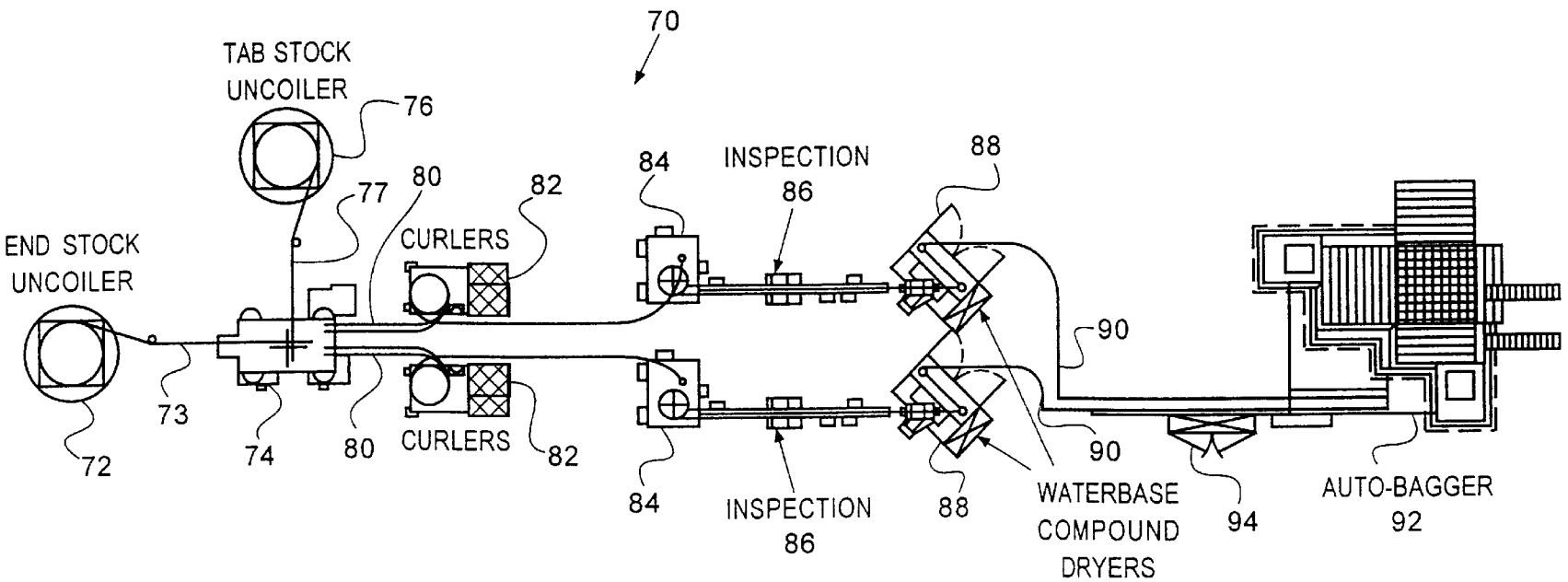
FIG. 2 is a plan view of a system for manufacturing can ends in accordance with a preferred embodiment of the invention.
Figure 3:
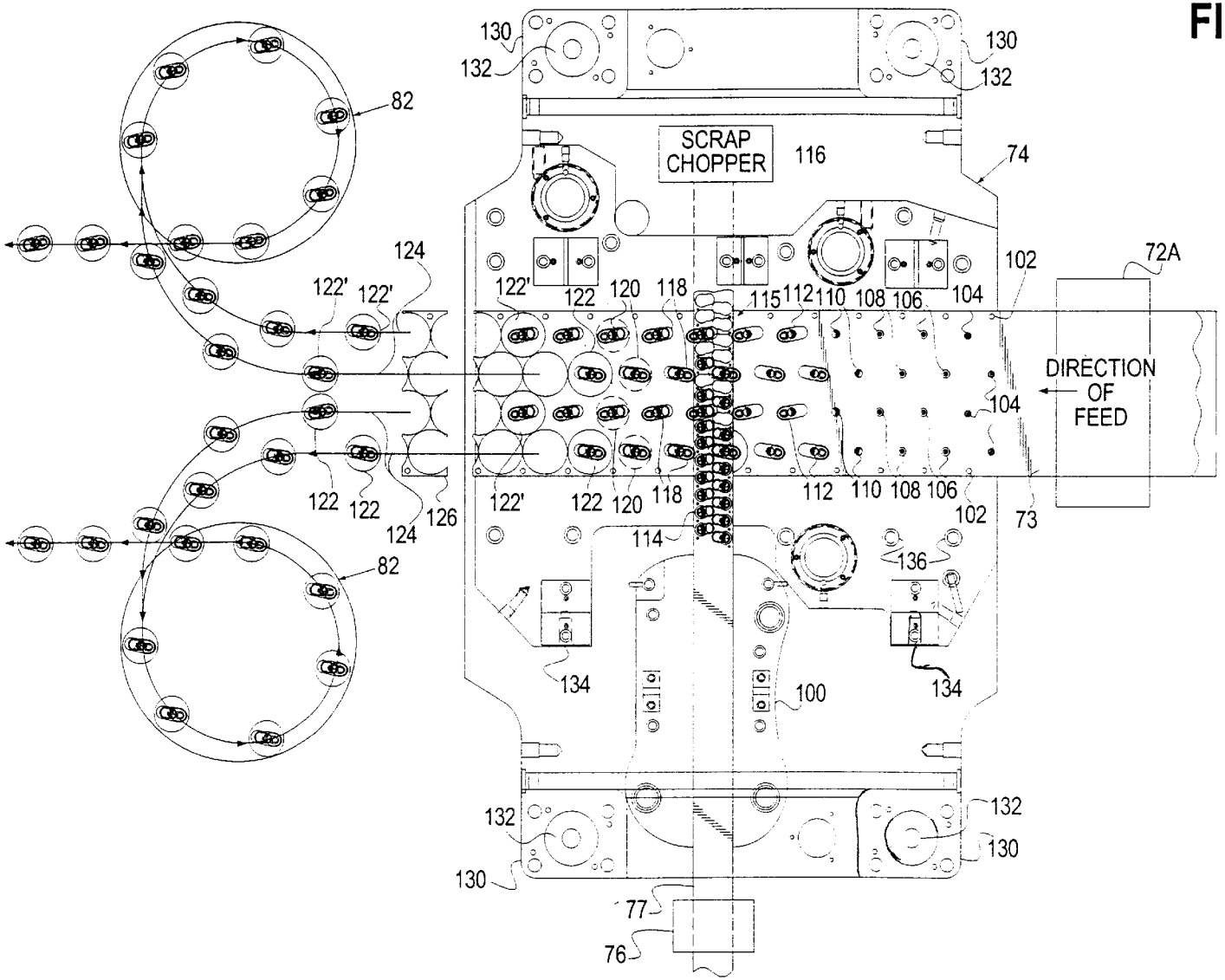
FIG. 3 is a detailed plan view of the press of FIG. 2, showing the movement of a sheet of end material though the press and the various operations performed thereon by the work stations in the press to form a can end therein from the sheet of end material.
Figure 4:
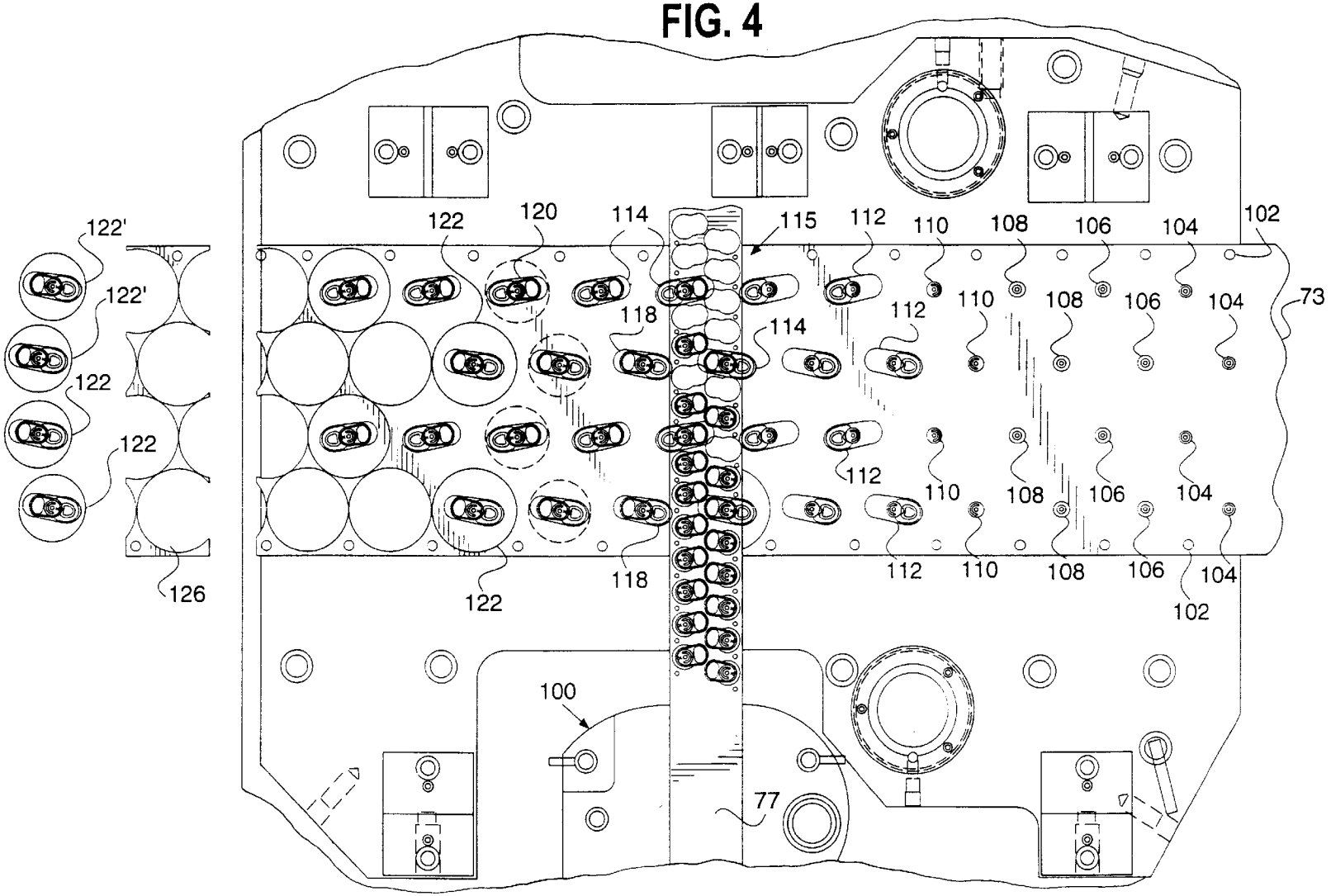
FIG. 4 is a more detailed plan view of the press of FIG. 3, showing in more detail the forming operations performed on the sheet of end material in the press.

Referring now to FIGS. 2–4, a new can end manufacturing system 70 in accordance with a presently preferred embodiment of the invention will be described. Referring now in particular to FIGS. 2 and 3, the system 70 includes an end stock uncoiler 72 that supplies a continuous sheet 73 of end material, such as aluminum or steel, to a coil stock feed mechanism 72A, which supplies the sheet 73 to a press 74. Similarly, a tab stock uncoiler 76 supplies a continuous sheet 77 of tab stock to the press 74. The press 74 is shown in greater detail in FIGS. 3 and 4 and will be described in detail below. Basically, the press 74 consists of a plurality of work stations that perform various forming operations on the sheet 73 of end material, the details of which will be dictated by customer requirements, and completes the formation of the ends in the sheet of end material. Simultaneously, the press 74 has work stations that continuously form tabs in the sheet 77 of tab stock, in known fashion. One of the work stations in the press attaches the tabs formed in the tab stock 77 to the sheet 73 of end material. While the sheet 73 of end material is advanced through the press 74, the sheet is maintained in a substantially continuous and void-free state, as described in further detail below, until the end is blanked from the sheet. This permits precise registration of the sheet relative to the work stations and overcoming the problems with web systems such as shown in the Buhrke and Hermann patents cited previously.

When the formation of the ends in the press 74 is complete, the ends are ejected from the press using forced air. In the instant embodiment, the press 74 is a four-out press, although this is not critical and will be dictated by the size of the ends, the type of stock used, the desired capacity of the machine and other factors. The ends are sent along track work 80 to two double curlers 82, where the periphery of the ends are curled in known fashion. In an alternative embodiment, the curling is performed by one of the stations in the press 74.

After curling, the ends are sent in stick form to one of two compound liner stations 84. A water-based compound sealer is applied to the ends in the stations 84. From there the ends are fed to an inspection station 86, and to one of two dryer stations 88 where the compound is subjected to heated forced air to dry the compound. If a solvent-based compound is used in the station 84, then no drier is needed. For the water-based compound embodiment, the ends are sent from the dryer stations 88 in stick form along tracks 90 to an automatic bagging station 92. The ends are bagged and loaded on pallets or other suitable structure and removed from the line. A control panel 94 is placed adjacent to the tracks 90, where a technician controls the operation of the machinery and views various data on the operation of the system 70.

Figure 1:
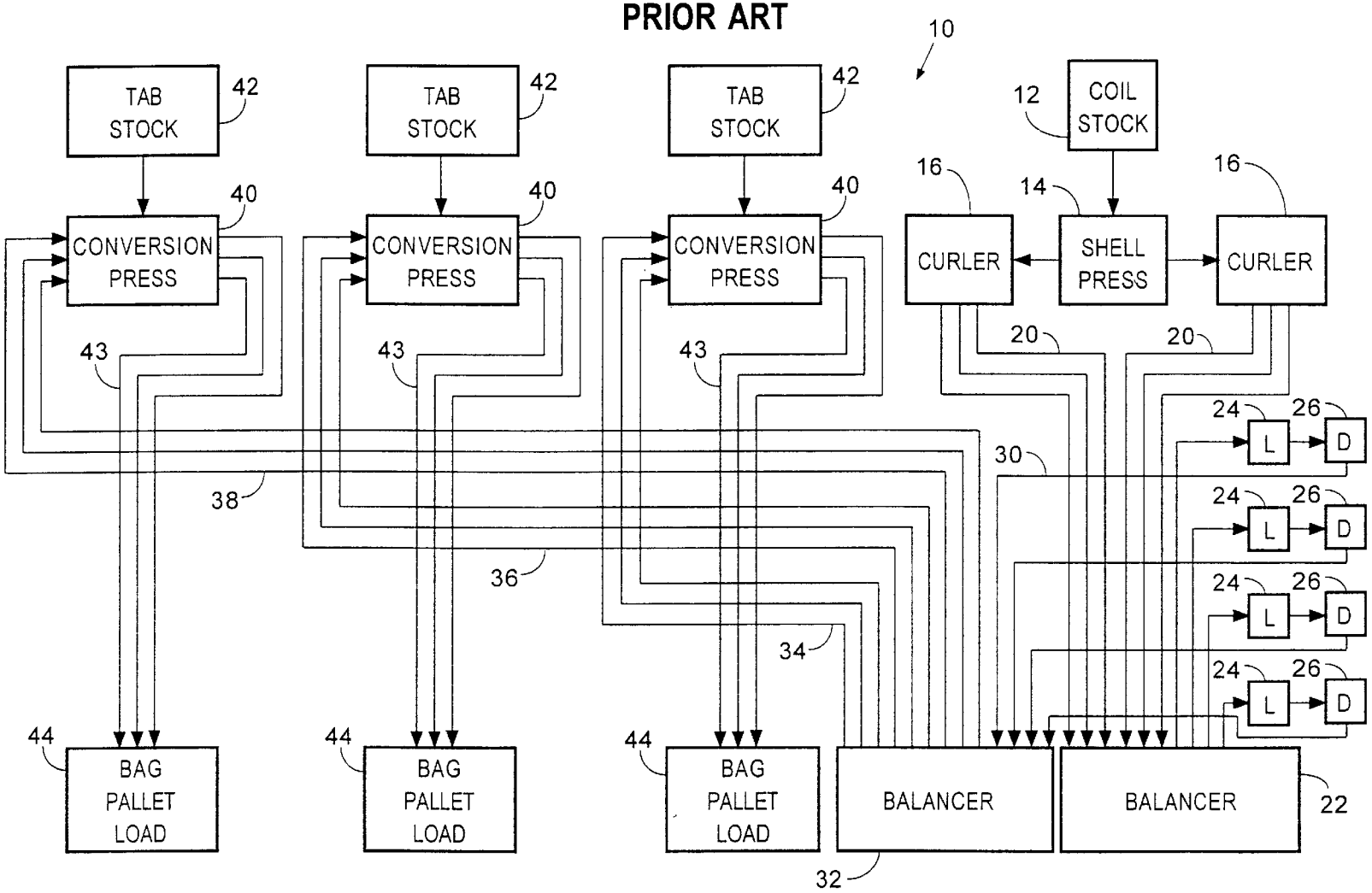
FIG. 1 PRIOR ART
FIG. 1 is a plan view of a system for manufacturing can ends known in the prior art.

Note that the system 70 of FIG. 2 is very much simplified as compared to the system of FIG. 1. There is only one press used to make the ends, press 74. There are no balancers. The track-work is very simple in design, and consists of relatively short lengths of track. The system is compact and requires a relatively small footprint and building site, lowering costs. Furthermore, due to the novel features of the press 74 described herein, the line is capable of operating at high speeds in a reliable fashion, maximizing the utilization of space, energy, and human resources. The system is also much easier and simpler to maintain since the design of the system is much simplified, and there are fewer machines to maintain.

Referring now to FIGS. 3 and 4, a presently preferred implementation of the press 74 per se will be described in detail. The press 74 includes a first set of tools organized into work stations that operate on the sheet of end material 73. The tools themselves are not shown, but are for the most part similar to the tools used in known conversion presses such as those provided by Stolle Machinery Inc. (now a division of ALCOA), and others, and can be modified by persons skilled in the art in view of the instant discussion. The work performed by the tools on the sheet 73 is shown in detail in the FIGS. The press also includes a second set of tools located in the region 100 that operate on the tab stock 77 to form a plurality of tabs therein. Such tools are known in the art and are similar to those described in the patent literature and provided with shell conversion presses currently sold by Stolle Machinery Inc. and other vendors. Therefore a discussion of such tools will be omitted. As shown in the figures, the tab stock travels at a right angle to the direction of travel of the end sheet stock, and the tabs are fastened to the sheet 73 of end stock in one of the work stations in the press 74 in the illustrated embodiment. In an alternative embodiment, the tab stock 77 could be fed at an oblique angle to the press 74 and looped around to obtain a better metal utilization rate.

As will be apparent, from FIGS. 2 and 3, the sheet 73 of end material is indexed through the press 74 in a right to left direction. The coiler 72 and coil stock feed mechanism 72A provide forward movement to the sheet 73 in order to advance the sheet 73 through the press. This indexing mechanism works in synchronism with a separate stock lifting mechanism in the press that provides up and down movement to the sheet to lift the sheet over the lower tools in the press as the sheet is advanced through the various stations. The stock lifting mechanism (not shown) is similar in design to the tab stock lifting mechanisms that are provided in known conversion presses. One of virtues of the press 74 is that the press works on a relatively short stroke for the tools. The amount of up and down lifting action by the stock lifting mechanism for the sheet 73 is considerably less than is required to lift individual ends up and down, as was required by prior art conversion presses. The shorter stroke results in less wear and maintenance costs, less energy utilization and faster speeds.

The work stations in the press include a first work stations that performs the first operations on the sheet 73 as it is introduced into the press. This station includes upper and lower tools that perform the following operations: punch two small pilot holes 102 in the extreme peripheral portions sheet 73, and form one ore more bubbles 104 in the sheet. The bubbles 104 are similar to the bubble 50 of FIGS. 1B and 1C and described previously, however but with a major difference being that the bubble is being formed in continuous sheet in the instant invention and not on an individual, fully formed shell as in FIGS. 1B and 1C). The bubbles 104 are precursors to rivets used to attach the tabs from the tab stock roll 77 to the sheet 73. As noted earlier, the instant embodiment is a four-out press therefore four such bubbles 104 are formed. The bubbles are oriented in a staggered arrangement as shown in order to maximize the utilization of the material in the sheet 73. The location of the bubbles 104 in the sheet will be dictated by the design of the end. In the present embodiment, the bubble is at the exact center of the to-be-formed end, but this is not necessarily the case. In particular, because precise registration of the sheet 73 is maintained relative to the tools in the press, the bubble can be in an off-set position relative to the center of the end and the tab can be reliably affixed to the end in such off-set position.

The small pilot holes 102 are used by the subsequent work stations of the press to maintain proper alignment of the sheet 73 relative to the work stations and associated tooling. The pilot holes also eliminate an accumulation of feed error. In particular, as the sheet 73 is indexed to the left in the press, the upper tooling in each of the work stations includes a pin, maintained in a fixed position with respect to the remainder of the tooling in that work station, that is inserted into the pilot hole. The placement of pilot holes 102 on opposite sides of the sheet 73 thus insures that proper registration is maintained in a direction parallel to the direction of travel, as well as perpendicular to the direction of travel. In an alternative embodiment, not every station need be provided with pins that engage the pilot holes 102. Even if only some of the stations are provided with the pins (say, every other station), there would still be no accumulation of feed error. All of these features result in the ability to push the sheet 73 through the press 74 at high speed and in a precise and completely controllable manner.

In another possible embodiment, the coil stock is fed to a separate machine off line where pilot holes are pre-formed on the coil stock and printing is added to the coil stock. The stock, with the pilot holes and printing already formed therein, is loaded on the stock uncoiler 72 and supplied to the press 74. In this embodiment, the first work station in the press does not have the tools to form the pilot holes 102 in the press, but rather has locating pins that are inserted into the pre-formed pilot holes to insure registration of the sheet as it is indexed into, and through the press.

Referring again to the right-hand side of FIGS. 3 and 4, after the operations of the first work station are performed, the tools open and the sheet is indexed to the left to a second work station. The upper tool in the second work station includes pins on opposite sides of the sheet 73 that engage the pilot holes 102. The tools come together and work the sheet by modifying the bubbles 104 in a first rivet operation, wherein the radius of the bubbles is reduced. The resulting first rivet feature is shown at 106. The operation of the second work station is similar, in the instant embodiment, to the operation illustrated in FIGS. 1D and 1E and described previously.

After the operations in the second work station are completed, the tools separate and the sheet 73 is indexed to the left to a third work station. In the third station, a second rivet operation is performed, indicated at 108, in which the radius of the first rivet feature 106 is further reduced. This is similar to the operation illustrated in FIGS. 1F and 1G.

Note that as the sheet is introduced into the press 73 and the first few operations are performed on the sheet 73, the sheet is maintained in a substantially continuous and void free state. (The presence of the small pilot holes 102 in the extreme periphery of the sheet 73 does not mean that the sheet is not in a substantially void free state, as the working area of the sheet, where the ends are formed, is continuous with no substantial voids). The pertinent consideration is that as the sheet 73 is advanced through the press 74, there is no elasticity in the movement of the sheet, as would occur if voids were formed in the sheet, such as shown in the Buhrke '442 patent cited previously. Note further that initial operations performed on the sheet are not shell forming operations, but rather the type of operations performed in a conversion press, and that the shell forming operations (forming the panel, countersink, and blanking operations) are performed on the sheet of stock material at the very end of the process.

After the third work station has completed the rivet operation indicated at 108, the tools separate and the sheet 73 is indexed to the left to a fourth work station. At the fourth work station, a score and bead operation is performed on the sheet, indicated at 110. The score forms an opening feature in the sheet of material. The bead takes up excess material in the sheet created in the scoring operation and stiffens the opening panel. The score and bead operation is similar to that shown in FIGS. 1H and 1I and described previously. The pilot holes 104 are used to maintain alignment between the sheet 73 and the fourth work station in the manner described previously.

After the fourth work station has completed the score and bead operations indicated at 110, the tools separate and the sheet 73 is indexed to the left to a fifth work station. At the fifth work station, a panel re-forming operation is performed on the sheet, indicated at 112. The panel reforming operation is similar to that shown in FIGS. 1J and 1K and described previously. The pilot holes 104 are used to maintain alignment between the sheet 73 and the fourth work station in the manner described previously.

After the fifth work station has completed the panel re-forming operation, the tools separate and the sheet 73 is indexed to the left to a fifth work station, which is an idle work station in the instant embodiment. The sheet 73 is then indexed to the left to a sixth work station, indicated at 115. At the sixth work station 115, four tabs 114 from the sheet 77 of tab stock are riveted to the second rivet structures 108 formed sheet 73. This operation is similar to that shown in FIGS. 1L and 1M and described previously. Tools for performing the operation of the sixth work station are similar to those known in the art and typically provided with conversion presses. In the instant embodiment, four such tabs are riveted since the press is a four-out press. The skeleton remaining from the sheet 77 of tab stock is cut with a chopper 116 and removed from the press.

Figure 1N:
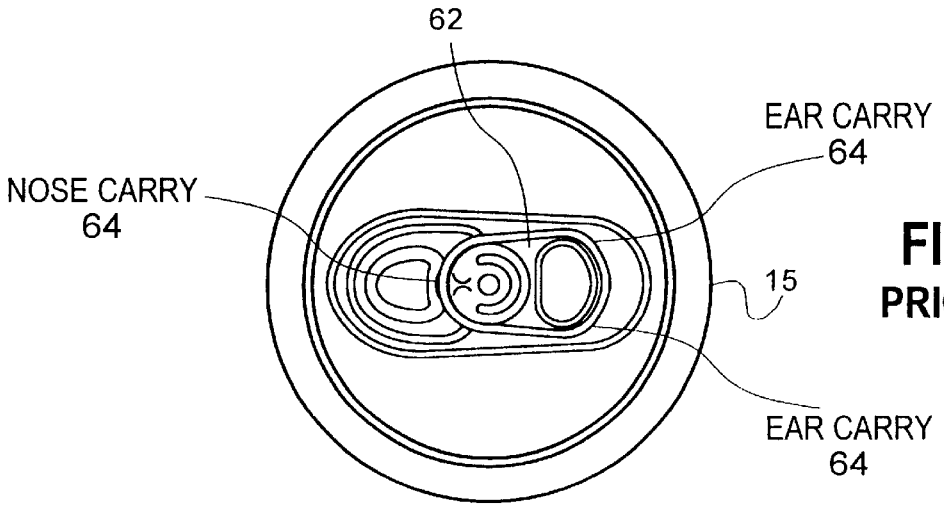
FIG. 1N PRIOR ART
FIG. 1N shows a seventh operation performed on the shell of FIG. 1A in the conversion press of FIG. 1.

The sheet is then indexed to the left to a seventh work station. Note that the sheet 73 continues to be maintained in a substantially continuous and void-free state. At the seventh work station, sharp edges in the tab are wiped down, as indicated at 118. This operation is similar to that shown in FIG. 1N and described previously. The tooling used in the seventh work station is also similar to that provided with known conversion presses.

Figure 1O:
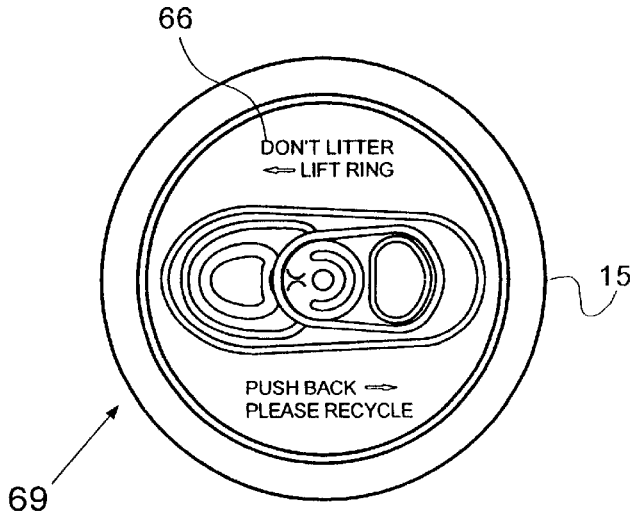
FIG. 1O PRIOR ART
FIG. 1O shows an eighth operation performed on the shell of FIG. 1A in the conversion press of FIG. 1.

When the operations of the seventh work station are completed, the sheet 73 is indexed to the left to an eight work station. At the eighth work station, lettering is incised or embossed onto the sheet 73, as indicated at 120. This operation is similar to that illustrated in FIG. 1O, and described previously. The operations of the seventh and eighth work stations could be interchanged. Further, the entire end forming process shown in FIGS. 3 and 4 could be changed depending on the particular requirements of the ends and the instant invention is not limited to the particular end or organization of tooling in the press illustrated in the drawings and described herein.

When the lettering is complete at the eighth work station, the sheet 73, still in a substantially continuous and void free state, is indexed to the left to a ninth work station. This station includes a set of tooling to blanks out two of the ends in the instant four-out embodiment. The ends are indicated at 122. This station forms the panel and countersink features in the end in one stroke, similar to that performed in the known Formatec shell presses. The sheet is indexed to the left to an idle station, and indexed again to the left to a tenth work station, where the panel and countersink features are provided in one stroke for the other two ends 122', blanking the ends from the sheet. The remaining skeleton is indexed to the left to an eleventh work station. The blanked ends are blown off the die on the up stroke of the press using forced air (similar to the technique used in the Formatec shell press) after the blank and form operation. The eleventh work station includes a chopper that cuts the scrap web skeleton 126 and deposits it below the press into a scrap baler as indicated.

Note again that the press in the preferred embodiment performs essentially the reverse of the prior art end forming process. The press of FIGS. 3 and 4 performs shell conversion operations in the sheet of material. It then forms the shell at the end of the process, with all the end features already formed in the sheet when the shell operation is performed (panel, countersink and blanking in one stroke).

In the instant embodiment, the press 74 does not have a curling station so the ends 122 and 122' are fed to double curlers, where the peripheral edge of the end is curled as shown in FIG. 1A. The ends 122 and 122' are discharged from the curlers 82 and fed to the compound liner modules 84 of FIG. 2. In an alternative embodiment, one of the stations in the press 74, preferebly a station at the left hand portion of the press, includes tools to curl the ends 122 and 122'.

The press 74 includes many mechanical details that are not considered to be part of the invention and will be known to persons skilled in the art who are familiar with the construction and operation of conversion presses. For example, the press includes press bed uprights 130, tie rods 132, stop blocks 134 that stop the stroke of the press, and leader pins 136 that are used to align the upper and lower tools in the work stations. Such details are therefore omitted.

From the foregoing description, it will be appreciated that we have described a method of manufacturing can ends 122, comprising the steps of:

(a) introducing a sheet 73 of end material into a press 74;

(b) moving the sheet of end material 73 to a series of work stations in the press;

(c) working the sheet 73 of end material in the series of work stations in a sequence of operations (such as indicated in the drawings at reference numerals 104, 106, 108, 110, 112, 115, 118, 120) so as to complete the formation of an end in the sheet of end material;

(d) during said step of working, maintaining the sheet 73 of end material in a substantially continuous and void-free state, thereby permitting precise movement of the sheet 73 relative to the work stations and registry of the sheet 73 relative to the work stations as the sheet is moved through the work stations;

(d) blanking the end 122 from the sheet 73 after the step of working has been completed; and (e) feeding the end 122 out of the press.

As noted previously, the particular details as to the working operations performed in the works stations of the press 74 are not considered important and may be in accordance with techniques used to make known styles and types of ends, such easy-open ends, press-tab ends, 202DRT ends of the type made by Dayton Reliable Tool and Mfg. Co. etc., or may be in accordance with newly developed techniques, types, or styles of ends.

The type of container that the end is formed for is unimportant. The step of working the sheet may comprise the step of forming an end for a beverage can, such as illustrated in the representative embodiment, but this need not be the case and ends for other types of cans could be made in the inventive press and system.

In one possible embodiment the step of working the sheet of end material may comprise the step of forming a rivet 108 in the sheet 73, scoring an opening feature in the sheet, and attaching a tab 114 to the rivet. The rivet may be formed over the process of operation of three stations, as described in the illustrated embodiment, or may be formed in a different number of work stations depending on the tools, material or type of rivet feature in question.

Additionally when the sheet 73 of end material is fed through the series of work stations along a feed direction (right to left in FIGS. 3 and 4), the series of work stations may be provided with tools to form a plurality of ends in a direction transverse or oblique to the feed direction. This feature is shown in drawings as the four-out arrangement shown in FIGS. 3 and 4, wherein four such ends are formed in a staggered arrangement in the sheet 73 as the sheet is advanced to the left through the press 74. As noted earlier, the number of ends formed in the transverse or oblique direction will depend on many factors such as the width of the sheet, the size of the ends, and so forth, and one-out, two-out, three-out, and other arrangements may be employed. The staggering of the ends as shown in FIGS. 3 and 4 is chosen to maximize the utilization of the material in the sheet, but is not strictly necessary and may vary.

Also, the method may be performed on an end that does not have a tab riveted to the end, such as found in earlier press-tab designs. In a more preferred embodiment, the method is practiced in conjunction with a step of supplying a sheet 77 having a plurality of tabs formed there to one of work stations (such as the work station 115 located where the tab sheet 77 intersects the sheet of end material 73 in FIG. 3), and wherein that work stations operates on the sheet 77 containing the tabs to attach at least one of the tabs 114 to the sheet 73 of end material.

In an embodiment in which a tab is attached to the end, work stations may be provided in the press 74 that include at least one station for forming a rivet in the sheet of end material (such as indicated at 108 by the second rivet operation, a station for scoring the sheet 73 so as to form an opening feature in the sheet, as indicated a 110, a station 115 for attaching one of the tabs 114 to the rivet 108, and a station for blanking the end 122 from the sheet 73 as indicated in the left hand side of FIGS. 3 and 4. Preferably the above-recited stations are arranged in the press such that the sheet of end material is fed through the stations in the recited order.

As noted earlier, the maintenance of registration of the sheet relative to the tooling in the work station permits a rivet and tab to be located in a position substantially displaced from the center of the end when the end is blanked from the sheet. This is a particularly useful feature in the manufacture of oversized beverage containers. In a prior art conversion press, placement of the rivet in a location other than the center of the end was a doubtful proposition because any rotation of the shell in the shell conversion press would adversely affect the rivet operation and to could lead to a leaker. Since the sheet of end material 73 in the present system (and the ends being formed therein) does not undergo any rotation as it is moved through the press, the rivet can be confidently place in an off-set location and the tabs will be attached to the rivets in exactly the right location.

Furthermore, the ability of the present system to reliably use off-set rivets allows more economical smaller tabs to be installed on larger ends. This can translate to a substantial cost savings over the life of the equipment.

Because the forming operations in the press 74 are performed on a sheet 73, instead of individual ends, a number of advantages are obtained. The grain properties of the sheet 73 can be accounted for in the tools in the press, since the grain direction will generally be known and will be consistent over a run. In prior art conversion presses the shells were fed with the grain in the shell occurring in a random direction, with no way of compensation for the grain in the tools of the press. Additionally, working on shells requires complex up and down movements of a belt containing the shells, lifting the belt and shells over the tools, lowering the belt and shells, raising the belt and shells to the next tool, lowering the belt, etc. In contrast a stock lifting mechanism can be provided for the sheet 73 that has simple up and down movement, with a much reduced stroke relative to that required for individual ends. This translates into a simpler mechanical design that is easier to maintain and less prone to problems found in belt-based shell system found in conversion presses. Additionally, there is no need for any vacuum systems in the present design, further lowering costs, increasing reliability, and reducing maintenance requirements.

The use of pilot holes in the preferred embodiment also enables smaller and simpler tool parts. There is no need for complex locator tooling such as found with belt systems since the pilot holes on the sheet are the primary locating mechanism.

While a presently preferred embodiment of the invention has been described, persons skilled in the art will appreciate that variations to the preferred design may be made without departure from the true scope and spirit of the invention. Such variations may be dictated by any number of factors, such as the type of end being made, the materials being used, the base machine that is used for the press 74, and other factors. This true scope and spirit of the invention will be found by-reference to the appended claims, interpreted in light of the foregoing specification.

We claim:

1. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material;

during said step of working, maintaining said sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press.

2. The method of claim 1, wherein said un-scrolled sheet of end material comprises aluminum.

3. The method of claim 1, wherein said step of working comprises the step of forming an easy-open end in said sheet of end material.

4. The method of claim 1, wherein said step of working comprises the step of forming an end for a beverage can.

5. The method of claim 1, wherein after said end is blanked from said press said end is fed to a curler station, a station for adding a sealing compound to said end, an inspection station and then to a bagging station.

6. The method of claim 1, further comprising the step of forming at least one pilot hole in the periphery of said sheet and using said pilot hole to maintain registration of said sheet relative to said work stations as said sheet is moved through said press.

7. The method of claim 1, wherein said un-scrolled sheet of end material is fed through said series of work stations along a feed direction, and wherein said series of work stations are provided with tools to form a plurality of tabs to attach at least one of said tabs to said un-scrolled sheet of end material.

8. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material; wherein said step of working comprises the steps of forming a rivet in said sheet, scoring an opening feature in said sheet, and attaching a tab to said rivet;

during said step of working, maintaining said un-scrolled sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press.

9. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material;

during said step of working, maintaining said sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press; the method further comprising the step of supplying a sheet containing a plurality of tabs to one of said work stations, and wherein said one of said work stations operates on said un-scrolled sheet containing a plurality of tabs to attach at least one of said tabs to said sheet of end material.

10. The method of claim 9, wherein said series of work stations comprises:

(a) at least one station for forming a rivet in said sheet;

(b) a station for scoring said sheet so as to form an opening feature in said sheet;

(c) a station for attaching said one of said tabs to said rivet; and (d) a station for blanking said end from said sheet.

11. The method of claim 10, wherein said stations (a)–(d) are arranged in said press such that said un-scrolled sheet of end material is fed through said stations in the order (a) through (d).

12. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material;

during said step of working, maintaining said sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press;

wherein a subset of said work stations form a rivet in said un-scrolled sheet of end material and wherein said rivet is formed in a position substantially displaced from the center of said end when said end is blanked from said sheet.

13. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material;

during said step of working maintaining said un-scrolled sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press; wherein said sheet of end material comprises a un-scrolled sheet of material having pre-formed pilot holes formed therein.

14. A method of manufacturing a can end, comprising the steps of:

introducing an un-scrolled sheet of end material into a press;

moving said un-scrolled sheet of end material to a series of work stations in said press;

working said un-scrolled sheet of end material in said series of work stations in a sequence of operations so as to complete the forming of finished opening features of said end in said un-scrolled sheet of end material;

during said step of working, maintaining said un-scrolled sheet of end material in a substantially continuous and void-free state, thereby permitting precise movement of said sheet relative to said plurality of work stations and registry of said sheet relative to said work stations as said sheet is fed through said work stations;

blanking said end from said sheet after said step of working has been completed; and feeding said end out of said press; wherein said un-scrolled sheet of end material has printing applied thereto prior to advancement of said sheet of material into said press.

* * * * *